US010532838B2

(12) United States Patent
Barnes et al.

(10) Patent No.: US 10,532,838 B2
(45) Date of Patent: Jan. 14, 2020

(54) CONSUMABLE AUTHENTICATION

(71) Applicant: Husqvarna AB, Huskvarna (SE)

(72) Inventors: Graham Frank Barnes, Lingfield (GB); Ian David Coles, West Sussex (GB)

(73) Assignee: Husqvarna AB, Huskvarna (SE)

( * ) Notice: Subject to any disclaimer, the term of this patent is extended or adjusted under 35 U.S.C. 154(b) by 616 days.

(21) Appl. No.: 15/260,951

(22) Filed: Sep. 9, 2016

(65) Prior Publication Data

US 2016/0376042 A1 Dec. 29, 2016

Related U.S. Application Data

(62) Division of application No. 12/447,449, filed as application No. PCT/GB2007/004102 on Oct. 29, 2007, now Pat. No. 9,457,921.

(30) Foreign Application Priority Data

Oct. 27, 2006 (GB) ..... 0621428.2

(51) Int. Cl.

| | |
|---|---|
| ***B21F 15/04*** | (2006.01) |
| ***B65B 13/28*** | (2006.01) |
| ***B65B 13/02*** | (2006.01) |
| ***B65B 13/18*** | (2006.01) |
| ***E04G 21/12*** | (2006.01) |
| ***B65D 83/02*** | (2006.01) |
| *B41J 2/175* | (2006.01) |

(52) U.S. Cl.

CPC ..... *B65B 13/285* (2013.01); *B65B 13/027* (2013.01); *B65B 13/185* (2013.01); *B65D 83/02* (2013.01); *E04G 21/122* (2013.01); *B41J 2/1755* (2013.01); *B65D 2203/10* (2013.01); *E04G 21/123* (2013.01)

(58) Field of Classification Search

CPC ... B65B 13/285; B65B 13/027; B65B 13/185; B65B 2203/10; B65B 83/02; E04G 21/122; E04G 21/123; B41J 2/1755

USPC ..... 72/462; 140/93.2

See application file for complete search history.

(56) References Cited

U.S. PATENT DOCUMENTS

| | | | | |
|---|---|---|---|---|
| 5,678,613 | A * | 10/1997 | Murayama | E04G 21/123 140/119 |
| 7,168,626 | B2 | 1/2007 | Lerch et al. | |
| 7,819,143 | B2 | 10/2010 | Nagaoka et al. | |
| 7,913,533 | B2 | 3/2011 | Lee et al. | |
| 8,122,916 | B2 | 2/2012 | Nagaoka et al. | |
| 9,457,921 | B2 * | 10/2016 | Barnes | B65D 83/02 |
| 9,630,802 | B2 * | 4/2017 | Nakagawa | B65H 75/14 |
| 2002/0188259 | A1 | 12/2002 | Hickle et al. | |

(Continued)

FOREIGN PATENT DOCUMENTS

| | | |
|---|---|---|
| DE | 10 2004 046 003 | 3/2006 |
| EP | 1346923 | 9/2003 |

(Continued)

*Primary Examiner* — David B Jones

(74) *Attorney, Agent, or Firm* — Knobbe, Martens, Olson & Bear, LLP

(57) ABSTRACT

A receptacle for a consumable material, such as a wire spool 2, to be loaded into a machine, such as a wire tying machine 18, comprises first and second indicating means 6, 12 for identifying the receptacle, wherein one of the indicating means 6 is separable from the receptacle.

9 Claims, 2 Drawing Sheets

(56) References Cited

U.S. PATENT DOCUMENTS

| | | | | |
|---|---|---|---|---|
| 2003/0025939 | A1 | 2/2003 | Jeran | |
| 2006/0283516 | A1 | 12/2006 | Nagaoka et al. | |
| 2007/0227613 | A1 | 10/2007 | Matsuoka et al. | |
| 2010/0163133 | A1 * | 7/2010 | Barnes ..... | B65D 83/02 140/1 |

FOREIGN PATENT DOCUMENTS

| | | | |
|---|---|---|---|
| JP | 2000-246921 | A | 9/2000 |
| JP | 2000317774 | A | 11/2000 |
| JP | 2003-036295 | A | 2/2003 |
| JP | 2005-251156 | A | 9/2005 |
| JP | 2005-320750 | * | 11/2005 |
| JP | 2006-166291 | A | 6/2006 |
| JP | 2009-098624 | A | 5/2009 |
| WO | WO 93/02816 | | 2/1993 |
| WO | WO 03/060817 | | 7/2003 |
| WO | 2005/108712 | * | 11/2005 |

* cited by examiner

CONSUMABLE AUTHENTICATION

CROSS REFERENCE TO RELATED APPLICATIONS

This application is a divisional of U.S. application Ser. No. 12/447,449, filed on Nov. 30, 2009 as the U.S. National Phase of PCT International Application Number PCT/GB2007/004102, filed on Oct. 29, 2007, which claims priority to United Kingdom Patent Application No. GB 0621428.2 filed on Oct. 27, 2006. The disclosures of the above-referenced applications are hereby expressly incorporated by reference in their entirety.

FIELD OF THE INVENTION

This invention relates to methods and means for verifying the authenticity of a consumable item when loaded into a corresponding machine. One particular, non-limiting application of the principles disclosed herein is to a wire spool for a wire tying machine.

BACKGROUND OF THE INVENTION

The problem of preventing the owner of a machine from using unauthorised consumable materials, that is consumable materials supplied by entities other than the supplier of the original machine or which are authorised by the supplier of the original machine, is a well known problem in many diverse fields. There may be several legitimate reasons for wanting to prevent the use of such unauthorised consumable items. Often the use of unauthorised consumables increases the risk of damage to the machine or poorer quality results achieved by the machine since such "after market" consumables are often of a lower quality than the authorised alternatives. The ongoing revenue from sales of consumables can also be an important factor in recouping the original development costs of the machine and/or allowing further development to be funded.

Several proposals have been made for the authentication of consumable products so as to enable the machine for example to warn the user of the risk being taken or even to prevent operation of the machine at all. However, the Applicant has recognised a particular problem in certain types of consumables where a genuine or authorised consumable receptacle can be refilled or reloaded with the consumable material and thus reused. This potentially gives rise to an even greater risk of damage or reduction in quality since such refilling or reloading would not necessarily be carried out with proper equipment.

SUMMARY OF THE INVENTION

It is an object of the present invention to tackle the aforementioned problem and when viewed from a first aspect the invention provides a receptacle for a consumable material to be loaded into a machine, said receptacle comprising first and second indicating means for identifying the receptacle, wherein one of the indicating means is separable from the receptacle.

The invention extends to a machine for receiving a receptacle for a consumable material, the machine comprising first and second detecting means for detecting the respective identifications provided by first and second indicating means on the receptacle, wherein the first and second detecting means are so configured that one of the indicating means on the receptacle must be separated from the receptacle before it can be detected by the machine.

Thus it will be seen by those skilled in the art that the invention provides a corresponding machine and consumable receptacle in which there are two separate identifiers of the receptacle which must be separated in order that they can both be read by the machine. What this means is that once a receptacle has been emptied of its consumable material it is impractical to reload and reuse it since once the second identifying means has been detached, it is impractical in most instances to keep the original receptacle and the detached identifying means together during the process of reloading/refilling and subsequently reusing.

The identifications provided by the first and second identifying means could be the same as each other so that it is simply necessary to compare them. In preferred embodiments however the identifications provided first and second identifying means are different, such that a knowledge of how they relate to each other is required. This adds a further level of security since the relationship can be kept secret making it more difficult to produce unauthorised receptacles with properly linked identifiers. The relationship could simply be defined by a look-up table, either stored in the machine or even interrogated remotely via a remote data link. Preferably however the two identifications are related by a predetermined algorithm. This is simpler and potentially allows an unlimited number of identifications. For example where the identifications are in the form of numbers the algorithm could comprise a mathematical relationship between them.

The identifying means could take any convenient form. To give a few, non-exhaustive examples, these might include a barcode, letter or number combinations, magnetic fields, raised and/or indented features shaped edge profiles (e.g. like a key) etc. It will be seen from this that the exact form of the identifying means is not essential to the invention. Similarly, the two identifying means do not need to be the same as each other. In presently preferred embodiments at least one and preferably both of the identifying means on the receptacle comprises a radio frequency identification (RFID) receiver as are well known.

The Applicant considers it sufficiently impractical in an industrial environment to keep together an empty receptacle and its corresponding identifier once the latter has been removed from the former during a refilling or reloading process that a user is effectively dissuaded from carrying this out. However, the Applicant envisages that when necessary further measures could be provided in order to prevent the refilling or reloading of the receptacle. In some embodiments envisaged for example one or other of the identifying means could be altered, erased or otherwise rendered ineffective at a suitable juncture, i.e. when a predetermined condition is met e.g. as the empty receptacle is removed from the machine or when the receptacle is determined by the machine, or by itself, to be empty. It will be appreciated that this would prevent refilling or reloading of the receptacle even if the detached identifying means were to be kept together with it. Of course, this function can be achieved by adding or removing any identifier from any part of the receptacle or detached identifying means.

Such an arrangement is considered to be novel and inventive in its own right and thus when viewed from a second aspect the invention provides a machine for receiving a receptacle for a consumable material, the machine comprising detecting means for detecting an identification provided by an indicating means on the receptacle, wherein the machine further comprises means for rendering the indicating means ineffective when a predetermined condition has been met.

In some embodiments said predetermined condition comprises removal of the receptacle from the machine. In other embodiments the predetermined condition comprises the receptacle being empty. This could be determined by the machine or by the receptacle itself.

The means for rendering the identifying means ineffective could be arranged to alter or erase the identifying means.

As in accordance with the previous aspects of the invention the identifying means could take any convenient form. To give a few, non-exhaustive examples, these might include a barcode, letter or number combinations, magnetic fields, raised and/or indented features shaped edge profiles (e.g. like a key) etc. It will be seen from this that the exact form of the identifying means is not essential to the invention.

Preferably the receptacle is in accordance with the first aspect of the invention—i.e. two identifying means are provided, one of which is removable.

The separable identifying means is preferably provided on a tab which is connected to the rest of the receptacle by a line of weakness allowing it easily to be snapped off by a user. The corresponding machine would then be provided with a corresponding aperture such as a slot to receive the tab which had been detached.

The machine could be arranged simply to warn the user if both identifying means are not detected or if the identifications provided by the two identifying means do not correspond to the same receptacle. In preferred embodiments however the machine is configured to prevent operation in such circumstances.

As thus far described the invention is generally applicable to a wide number of consumable materials for machines. Some exemplary application envisaged include ink cartridges for computer printers, cartridges for drinks dispensing machines, gas/powder cartridges for inhalers, blood products or indeed any other application where a consumable product is used with a machine.

However, another specific application envisaged is in the field of spools of wire for wire tying machines. Thus in at least some embodiments the receptacle is in the form of a spool onto which wire is wound or can be wound. The corresponding machine is a wire tying machine which is adapted in use to automatically tie a length of wire around one or more objects by twisting the ends together. It can be very important with such machines to ensure that the right kind, size and tension of wire is used to ensure reliable operation of the tying machine. Indeed, it may even be necessary to ensure that the surface of the wire or its coating has the right properties of friction. By employing the present invention as set out above, the user of the spool is effectively prevented from rewinding the spool with an inappropriate wire or in an inappropriate way.

When viewed from a further aspect the invention provides a spool for a wire to be loaded into a machine, said spool comprising first and second indicating means for identifying the spool, wherein one of the indicating means is separable from the spool.

The invention extends to a wire tying machine for receiving a wire spool, the machine comprising first and second detecting means for detecting the respective identifications provided by first and second indicating means on the spool, wherein the first and second detecting means are so configured that one of the indicating means on the spool must be separated from the spool before it can be detected by the machine.

BRIEF DESCRIPTION OF THE DRAWINGS

Certain preferred embodiments of the invention will now be described, by way of example only, with reference to the accompanying drawings in which.

DETAILED DESCRIPTION OF THE PREFERRED EMBODIMENTS

Figure 1B:
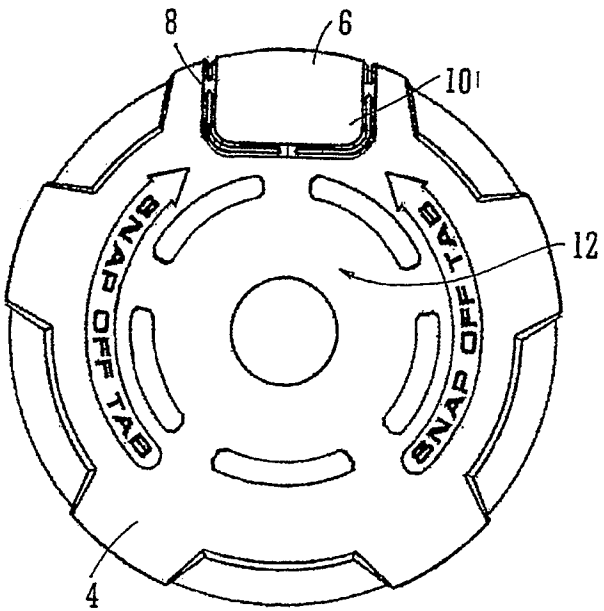
FIG. 1 A and FIG. 1B show plan and end elevations of a wire spool embodying the invention.
Figure 1A:
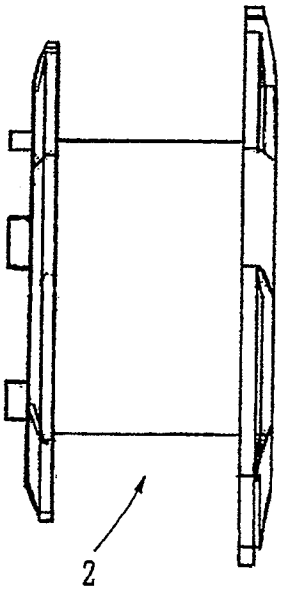

FIG. 1A and FIG. 1B show a spool 2 around which a wire for use in a wire tying machine can be wound. The spool 2 is of broadly conventional shape and construction, typically being moulded of plastic. However the upper flange 4 of the spool exhibits some novel features. Firstly a tab 6 is defined in one region of the flange 4 by a series of elongate slots so that it remains attached to the rest of the flange by three web sections 8. The precise attachment of the of the tab is not critical as long as it can be snapped off—i.e. permanently detached—from the spool. The tab 6 has an embossed code 10 on it. However it also contains an embedded RFID chip bearing either this code or one derived from it.

Meanwhile the upper spool flange 4 carries a second embossed code 12 and a second RFID chip which carries the second code 12 or one derived from it. It also has embossed directions to snap the tab off.

The two codes 10, 12 do not immediately appear to bear any relationship to each other. However there is a predefined relationship between them in the form of an algorithm to turn one into the other (although it need not necessarily be reversible) to allow them to be compared to check that they belong to the same spool.

Figure 4:
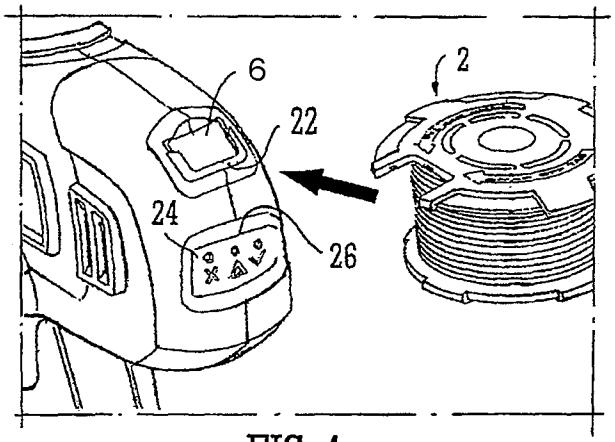
FIG. 4 is a partial view showing a tab separated from the spool and inserted into the machine.
Figure 2:
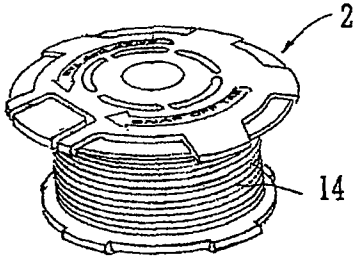
FIG. 2 shows a perspective view of the spool of FIG. 1A and FIG. 1B wound with wire.
Figure 3:
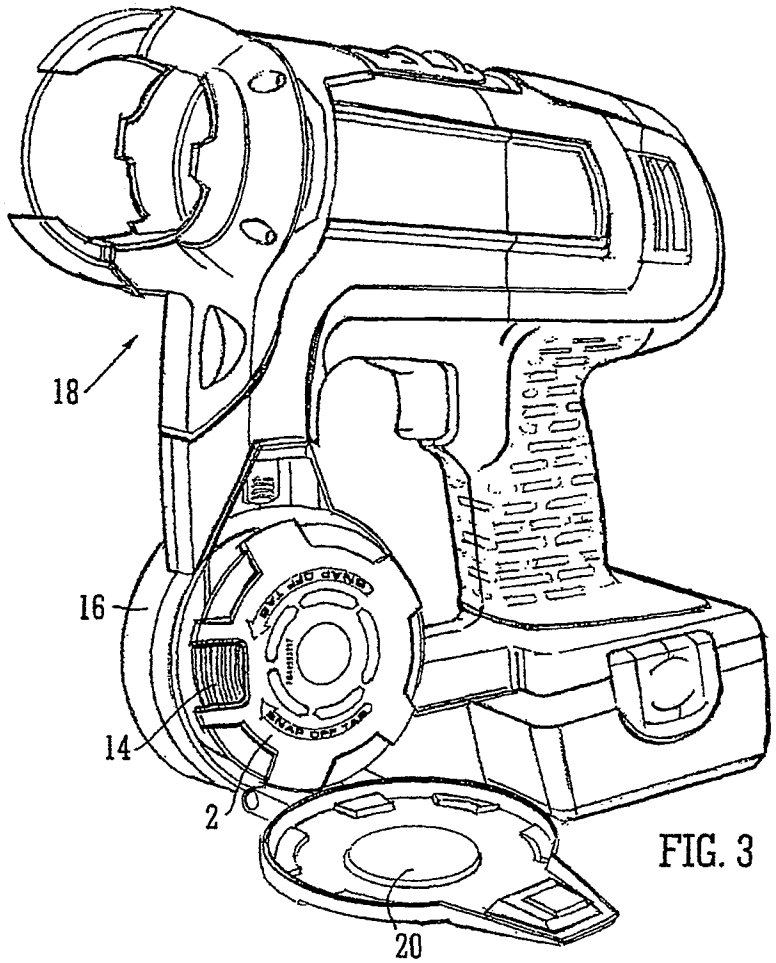
FIG. 3 shows a wire tying machine after the spool of FIG. 2 has been loaded into it.

FIG. 2 shows the spool 2 wound with wire 14. In FIG. 3 the spool 2 is shown loaded into the spool compartment 16 of a wire tying machine 18. The compartment cover 20 is shown left open to allow the spool to be seen. It will be seen from this that prior to insertion of the spool the tab 6 is snapped off to reveal the wire 14 beneath. As is shown in the inset FIG. 4, once the tab 6 is separated from the spool 2 it is slotted into a suitable slot 22 in the rear of the machine 18.

The spool compartment 16 and the tab slot 22 both contain very short range RFID interrogators which read the codes of the embedded RFID chips in the spool and tab respectively. These are then communicated to a microprocessor or ASIC in the machine (not shown) which applies a predetermined algorithm to the codes to determine whether they match. As long as the tab 6 comes from the spool 2 currently loaded into the spool compartment 16 of the machine, these codes will match and so the control electronics can permit normal operation of the machine. If the codes do not match or both codes are not supplied, for example if an unauthorised spool has been loaded or a spool has been rewound and so no longer has its original tab, an error LED 24 or a warning LED 26 can be lit. Thereafter the machine may not operate at all or might, for example, operate at a lower speed to minimise the risk of damage that could arise from an inferior wire or an incorrectly wound spool.

Although rather impractical, the protective system described above could theoretically be defeated by keeping the spool 2 and its original tab 6 together while the spool was rewound. However even this can be prevented by simply arranging for the machine to alter or render inoperative one or other of the identifying means—i.e. the RFID chips in the spool or tab 6. This could be after the code has been initially read or once the spool has been detected to be empty (the latter allows the spool to be removed and reinserted during use if necessary for any reason). Another alternative would be for the machine to store details of the spools/tabs that it has read in a suitable non-volatile memory and to reject any code that it has seen already.

An application of the invention to wire spools has been shown but this could be extended to any manner of consumables e.g. a spool of plastic wire for a lawn strimmer, a printer ink/toner cartridge to name just two.

What is claimed is:

1. A spool for a wire to be loaded into a machine, said spool comprising first and second indicators for identifying the spool, wherein the spool comprises a flange, wherein a tab is defined in the flange, wherein the tab comprises the first indicator, wherein the tab is connected to the flange by a line of weakness between the flange and the tab that allows the tab to be separated from the spool.

2. A spool as claimed in claim 1 wherein the first and second indicators provide first and second identifications respectively, wherein the first and second identifications are different.

3. A spool as claimed in claim 2 wherein the first and second identifications are related by a predetermined algorithm that defines a mathematical relationship between the first and second identifications.

4. A spool as claimed in claim 1 wherein at least one of the indicators on the spool comprises a radio frequency identification chip that provides a radio frequency identification.

5. A receptacle for a consumable material to be loaded into a machine, said receptacle comprising first and second indicators for identifying the receptacle, wherein the receptacle comprises a flange, wherein a tab is defined in the flange, wherein the tab comprises the first indicator, wherein the tab is connected to the flange by a line of weakness between the flange and the tab that allows the tab to be separated from the receptacle.

6. A receptacle as claimed in claim 5 wherein the first and second indicators provide first and second identifications respectively, wherein the first and second identifications are different.

7. A receptacle as claimed in claim 6 wherein the first and second identifications are related by a predetermined algorithm that defines a mathematical relationship between the first and second identifications.

8. A receptacle as claimed in claim 5 wherein at least one of the indicators on the receptacle comprises a radio frequency identification chip that provides a radio frequency identification.

9. A receptacle as claimed in claim 5 wherein the receptacle is in the form of a spool for a wire to be wound.

* * * * *